US010779624B2

(12) United States Patent
Kumalarasan

(10) Patent No.: US 10,779,624 B2
(45) Date of Patent: Sep. 22, 2020

(54) RE-USABLE PROTECTIVE SHEATH FOR PORTABLE ELECTRONIC DEVICES

(71) Applicant: Premashanth Kumalarasan, Scarborough (CA)

(72) Inventor: Premashanth Kumalarasan, Scarborough (CA)

( * ) Notice: Subject to any disclaimer, the term of this patent is extended or adjusted under 35 U.S.C. 154(b) by 0 days.

(21) Appl. No.: 16/032,099

(22) Filed: Jul. 11, 2018

(65) Prior Publication Data

US 2019/0014877 A1 Jan. 17, 2019

Related U.S. Application Data

(60) Provisional application No. 62/530,875, filed on Jul. 11, 2017.

(51) Int. Cl.

| | |
|---|---|
| ***A45C 13/36*** | (2006.01) |
| ***B65D 81/02*** | (2006.01) |
| *A45C 11/00* | (2006.01) |

(52) U.S. Cl.

CPC ..... *A45C 13/36* (2013.01); *B65D 81/022* (2013.01); *A45C 2011/002* (2013.01); *A45F 2200/0516* (2013.01)

(58) Field of Classification Search

CPC ..... A45C 13/36; A45C 2011/002; A45C 2011/001; A45C 2011/003; H04B 1/3888; H04M 1/0249; B65D 81/02; B65D 81/022; A45F 2200/0516

USPC ..... 206/320

See application file for complete search history.

(56) References Cited

U.S. PATENT DOCUMENTS

| | | | | |
|---|---|---|---|---|
| 2,164,299 A * | 6/1939 | Mandell | A47G 1/08 | 40/741 |
| 2,185,084 A * | 12/1939 | Hutaff, Jr. | B60R 13/105 | 248/488 |
| 5,299,685 A * | 4/1994 | Chin | B65D 81/02 | 206/320 |
| 5,368,159 A * | 11/1994 | Doria | H01H 9/0242 | 206/320 |
| 6,236,312 B1 * | 5/2001 | Chitsazan | G08B 21/24 | 340/539.32 |
| 6,616,111 B1 * | 9/2003 | White | G06F 1/1626 | 206/320 |
| 8,359,078 B2 * | 1/2013 | Hung | H04M 1/04 | 379/437 |

(Continued)

*Primary Examiner* — Steven A. Reynolds
(74) *Attorney, Agent, or Firm* — Tatonetti IP

(57) ABSTRACT

A multi-component sheath to protect portable electronics devices. The device provides coarse adjustment in height-direction or y-direction. A region enabling connection between the upper piece and lower piece allowing significant extension of the mechanism along the longest axis of the portable electronic device. An additional fine adjustment in both height-direction or y-direction and width or y-direction is also possible. Minor expansion of the pieces in the longitudinal and transverse directions of the portable electronic device, due to intrinsic elongation and stretch characteristics of the sheath material (e.g. polymer or rubber). The device provides minimalist coverage of the portable electronic device on the back and sides. The present invention provides protection mostly in the corners. The present invention results in a minimal increase in overall thickness of the portable electronic device, less than 2 mm. The device allows full access to all input/output connections and buttons of the device.

10 Claims, 9 Drawing Sheets

(56) References Cited

U.S. PATENT DOCUMENTS

| | | | | |
|---|---|---|---|---|
| 9,264,526 | B1 * | 2/2016 | Burns | H05K 5/0086 |
| 9,362,971 | B2 * | 6/2016 | Radmard | H04M 1/185 |
| D764,478 | S * | 8/2016 | Radmard | H04M 1/185 D14/250 |
| 9,565,913 | B2 * | 2/2017 | Fathollahi | A45C 13/002 |
| 9,847,806 | B1 * | 12/2017 | Dickie | H04B 1/3888 |
| 10,404,311 | B2 * | 9/2019 | Rothberg | H04B 1/3888 |
| 2013/0270850 | A1 * | 10/2013 | Fan | A45F 5/00 294/137 |
| 2014/0097110 | A1 * | 4/2014 | Shieh | G06F 1/1679 206/320 |
| 2017/0156467 | A1 * | 6/2017 | Fathollahi | A45C 13/002 |
| 2019/0020369 | A1 * | 1/2019 | Rothberg | H04M 1/04 |

* cited by examiner

RE-USABLE PROTECTIVE SHEATH FOR PORTABLE ELECTRONIC DEVICES

FEDERALLY SPONSORED RESEARCH

Not Applicable

SEQUENCE LISTING OR PROGRAM

Not Applicable

TECHNICAL FIELD OF THE INVENTION

The present invention relates in general to protective cases. More specifically, the present invention relates to protective cases comprising an adjustable multi-component sheath which provides protection primarily in the high risk damage areas of portable electronic devices.

BACKGROUND OF THE INVENTION

Portable electronic devices such as smart-phones have become an essential commodity for everyday life. An ever increasing amount of sophisticated technology is assembled into smaller packages creating higher value products for consumers.

However, with increasing utility and usage, these devices are subjected to potential damage due to mis-handling, dropping, etc., requiring the need for scratch and shock protection of these increasingly expensive devices. In particular, this need for protection of these devices is most acute in the corners of the device which are easily damaged and transfer mechanical shock to the rest of the device, and also the screen.

Furthermore, a suitable form of device protection must allow fast and direct access to the input & outputs media of the device (e.g. jacks and buttons).

In addition, the protective cover must be slim and minimalist, thereby not increasing the bulk and weight to the devices which are designed to be portable, handheld and stored in the pocket. Moreover, with the wide proliferation and rapid model changeover of devices such as smart-phone (e.g. Apple iPhone and Samsung Android series), the protective cover should be ideally re-usable across a broad range of devices.

SUMMARY OF THE INVENTION

The present invention is an adjustable multi-component sheath which provides protection primarily in the high risk damage areas of portable electronic devices, i.e., the corners.

BRIEF DESCRIPTION OF THE DRAWINGS

The accompanying drawings, which are incorporated herein and form a part of the specification, illustrate the present invention and, together with the description, further explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figure, it is possible to see the various major elements constituting the apparatus of the present invention.

The present invention is a multi-component sheath to protect portable electronics devices. The present invention provides coarse adjustment in height-direction or y-direction. A region enabling connection between the upper piece and lower piece allowing significant extension of the mechanism along the longest axis of the portable electronic device.

An additional fine adjustment in both height-direction or y-direction and width or y-direction is also possible. Minor expansion of the pieces in the longitudinal and transverse directions of the portable electronic device, due to intrinsic elongation and stretch characteristics of the sheath material (e.g. polymer or rubber).

The present invention provides minimalist coverage of the portable electronic device on the back and sides. The present invention provides protection mostly in the corners. The present invention results in a minimal increase in overall thickness of the portable electronic device. The thickness of the material comprising the mechanism is less than 2 mm. Finally, the device allows full access to all input/output connections and buttons of the device.

Figure 1:
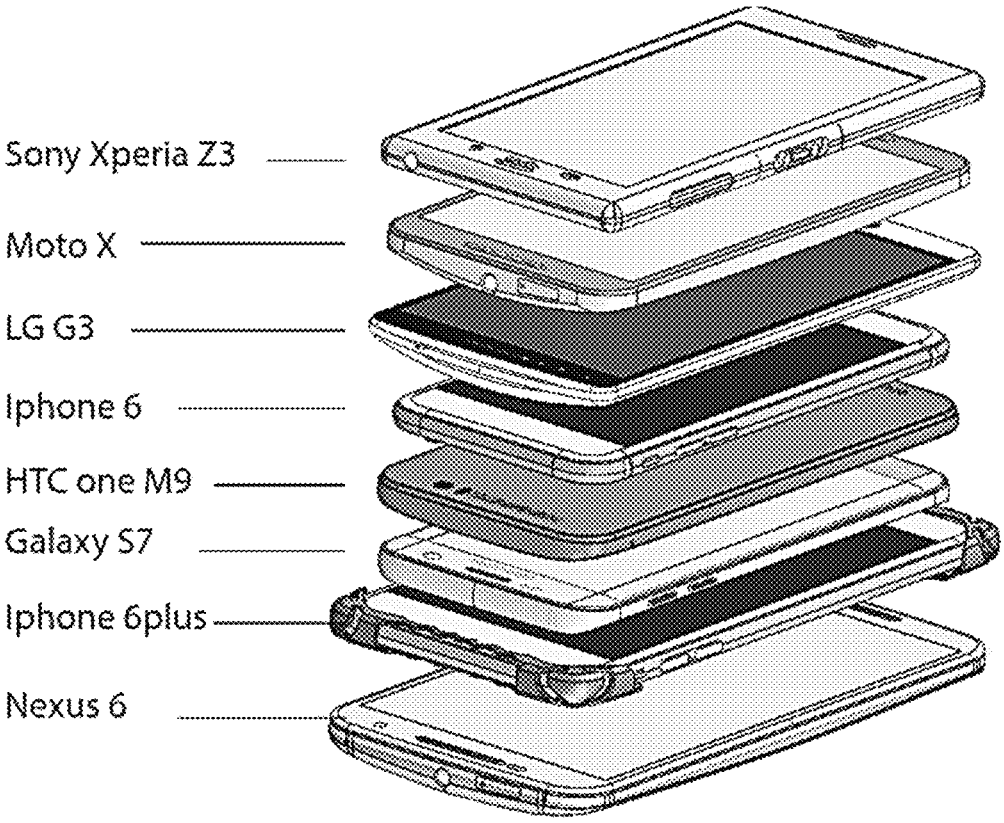
Fig. 1 PRIOR ART
FIG. 1 illustrates a plurality of portable electronics devices to which the invention has been successfully applied.

FIG. 1 shows portable electronics devices to which the invention has been successfully applied, namely: SONY XPERIA Z3, MOTO X, LG G3, APPLE IPHONE 6, HTC ONE M9, SAMSUNG GALAXY S7, APPLE IPHONE 6-PLUS & GOOGLE NEXUS.

Figure 2:
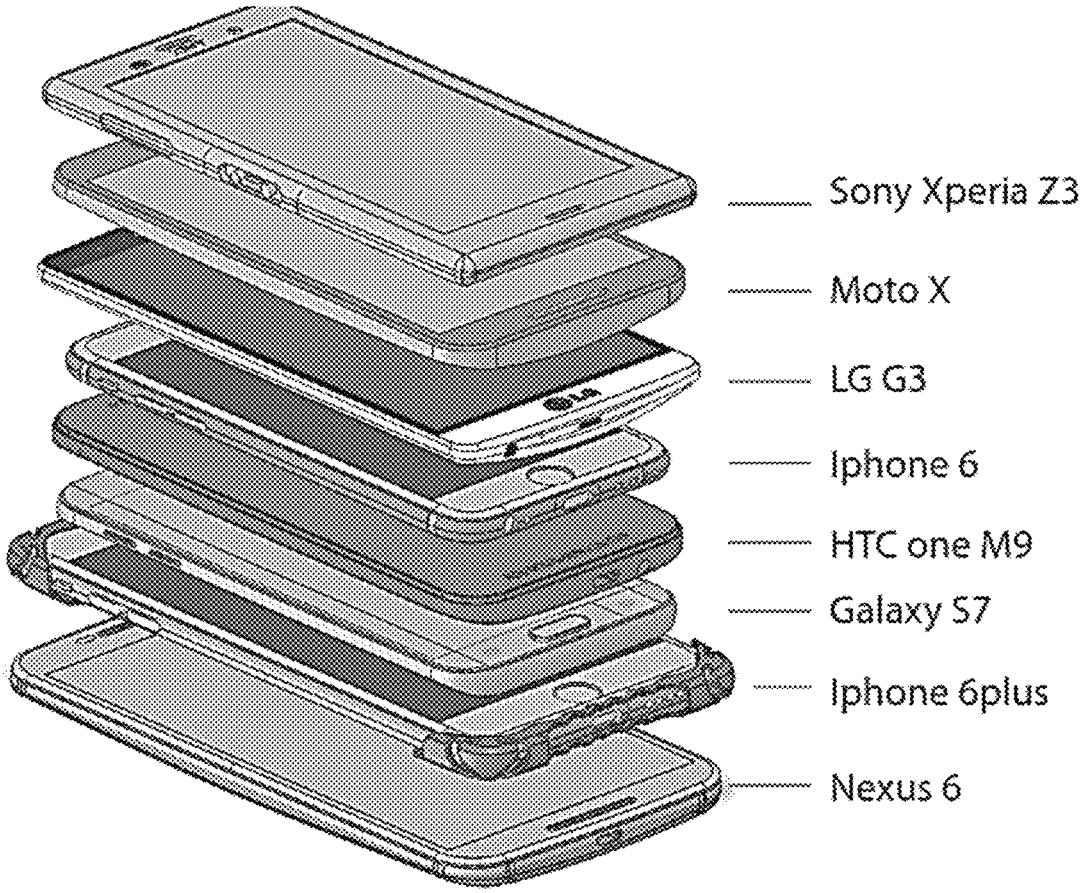
Fig. 2 PRIOR ART
FIG. 2 illustrates another view of the aforementioned electronic devices.

FIG. 2 shows another view of the aforementioned electronic devices and the required adjustment directions.

Figure 3:
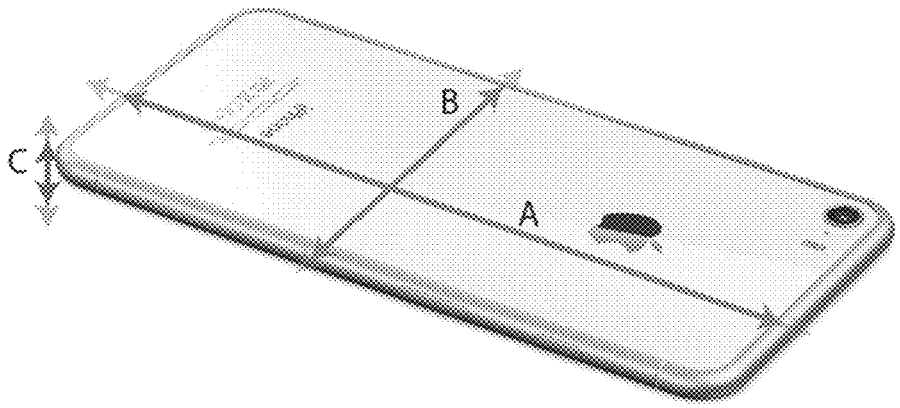
FIG. 3 illustrates the adjustment directions which the invention must accommodate, that being the length (A), width (B), and depth (C) of the portable electronic device.

FIG. 3 shows the adjustment directions which the invention must accommodate, that being the length (A), width (B), and depth (C) of the portable electronic device.

Figure 4:
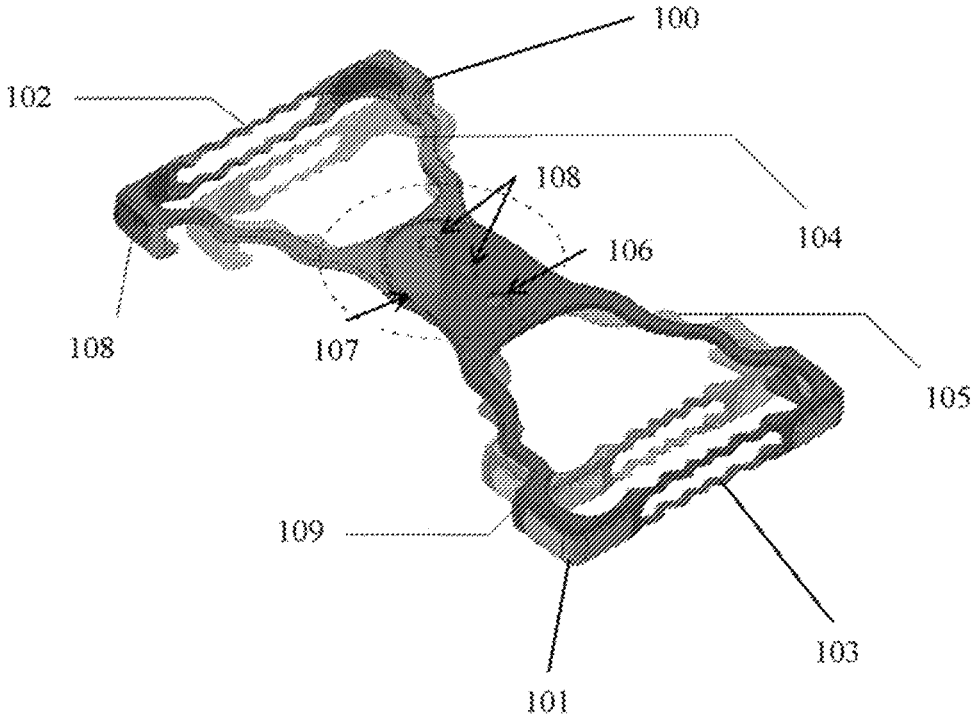
FIG. 4 shows an isometric view of the invention, comprising a two-component sheath comprised of a plurality of sub-components.

FIG. 4 illustrates the component parts of one embodiment of the present invention. The components parts are an upper part 100 and a lower part 101, each comprised of a stretch/rubber frame comprised of a stretch rubber end section 102 and 103 and a diagonal stretch section 104 and 105 and a protection/rubber over-mold 108 and 109 that extends around the ends and corners of an electronic device and partially down a back surface 110. Each part also has a fitting lock 107 on the opposing end of the protection/rubber over-mold 102 and 103 that extends around the ends and corners of an electronic device. These opposing ends 102 and 103 are designed to secure or lock the two parts together at the fitting lock 107. In FIG. 4, the fitting lock 7 is shown where one part end is comprised of a plurality of holes 106 and the other a plurality of protrusions 108 that interlock and are adjustable.

FIG. 4 shows an isometric view of the invention, comprising a two-component sheath 100 and 101 comprised of the following sub-components: a stretchable member between the corners 102 and 103, stretchable members 104 and 105 connecting the corners to the center region of each sheath, and a fitting lock 107 between each component.

The invention consists of a multi-component, expandable sheath comprised of a nominally stretchable material, such as rubber or polymer of moderate elongation, providing protection of electronic devices, mostly in the corners while allowing access to buttons, jacks, camera and other input/output means of the device. The two part expandable sheath is typically made of two components which are connected through an adjustable interlock mechanism which allows for large expansion of the two part sheath system in one direction of the electronic device. The protection of the corners of the device may incorporate rubber or polymeric reinforcement for additional shock and vibration protection.

The invention is designed to be used on a wide range of electronic devices, as shown in FIGS. 1-2. The present invention has been successfully employed on an extremely wide range of manufacturer makes and model such as: SONY XPERIA Z3, MOTO X, LG G3, APPLE IPHONE 6, HTC ONE M9, SAMSUNG GALAXY S7, APPLE IPHONE 6-PLUS & GOOGLE NEXUS.

Figure 5:
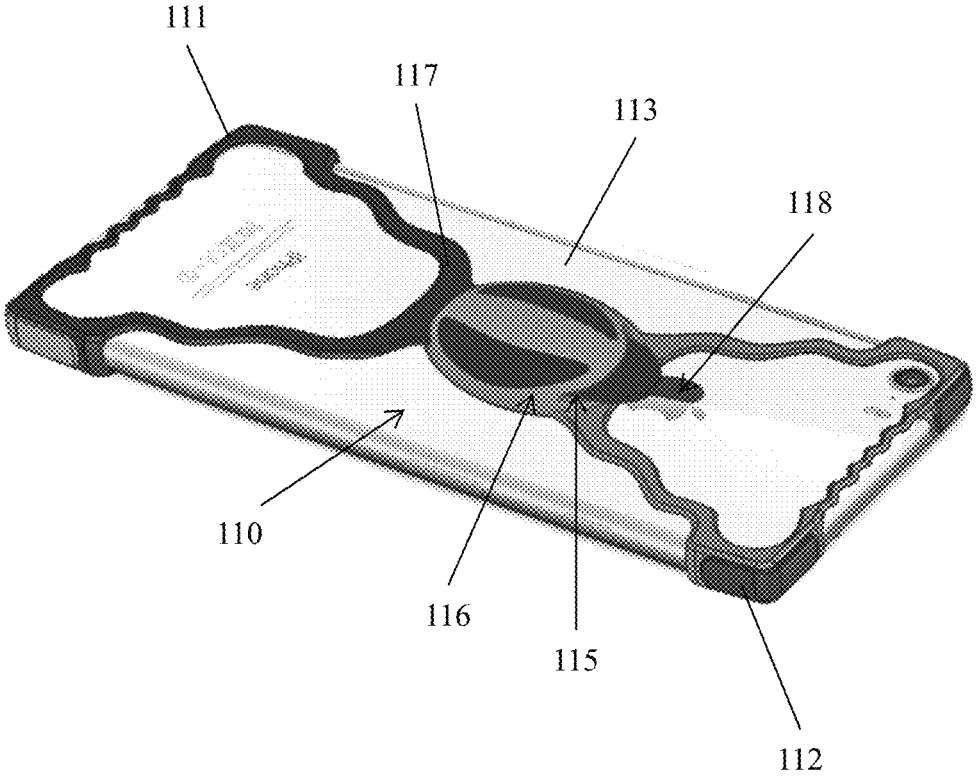
FIG. 5 illustrates one embodiment of the present invention where 2-pieces of the thin flexible protective sheath are connected in the middle of the device.

FIG. 5 shows one embodiment of the invention. The two pieces 111 and 112 of the thin flexible protective sheath are connected in the middle of the device 113. In this embodiment, the fitting lock is comprised of a substantially circular slot 115 on one part 116 while the opposing part 117 has an oblong pull tab 118.

Figure 6:
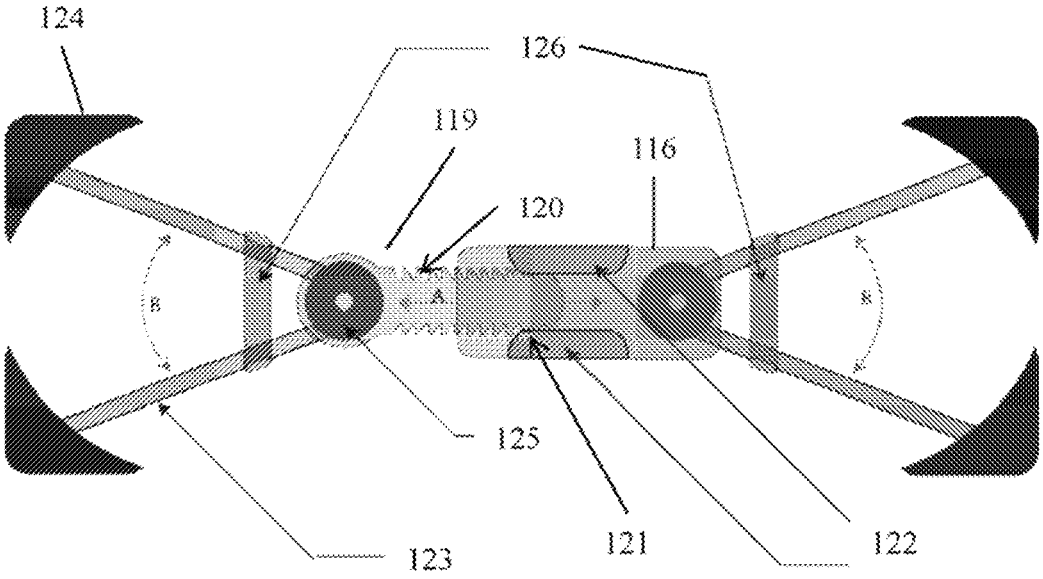
FIG. 6 illustrates an alternative embodiment of the present invention where the 2-pieces of the thin flexible protective sheath are connected in the middle of the device using a hindge and release button mechanism.

FIG. 6 illustrates the internal components of the fitting lock, where the part with the pull tab also has a substantially rectangular section 119 with a number of angled serrations 120. The angled serrations 120 fit in to corresponding angled serrations 121 on the opposing part 116. Their angular nature allows them to be pulled in to decrease the size of the device, while not being able to release or extend. One or more release buttons 122 are provided whereby squeezing the two sides of the opposing part 116 results in a deformation of the interior serrations 121 or channels and allows the parts 117 and 116 to extend away from each other.

In the embodiment of FIG. 6, metal bars 123 comprise the frame of each of the two body parts 117 and 116. The metal bar frames 123 connect to molded corners 124 that are secured around the corners of an electronic device. On the opposing end of the metal bar frames, they are attached to a circular hinge 125. Rubber tension controls 126 can be secured to the metal bar frames 123 to help in fitment and securement to an electronic device.

Figure 7:
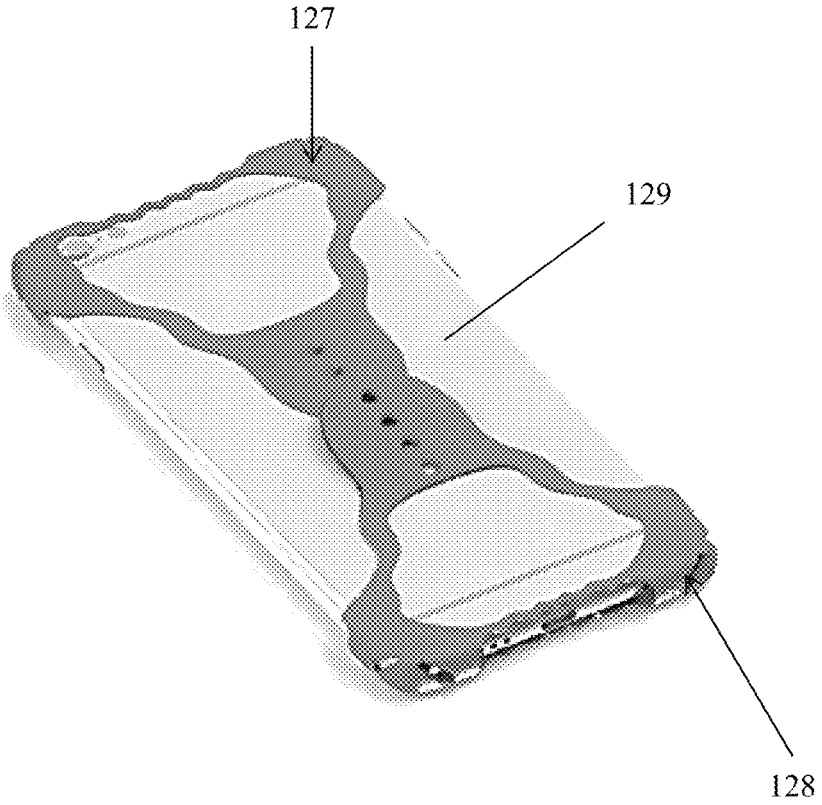
FIGS. 7-8 illustrate an alternative embodiment of the present invention where the 2-pieces of the thin flexible protective sheath are connected in the middle of the device.
Figure 8:
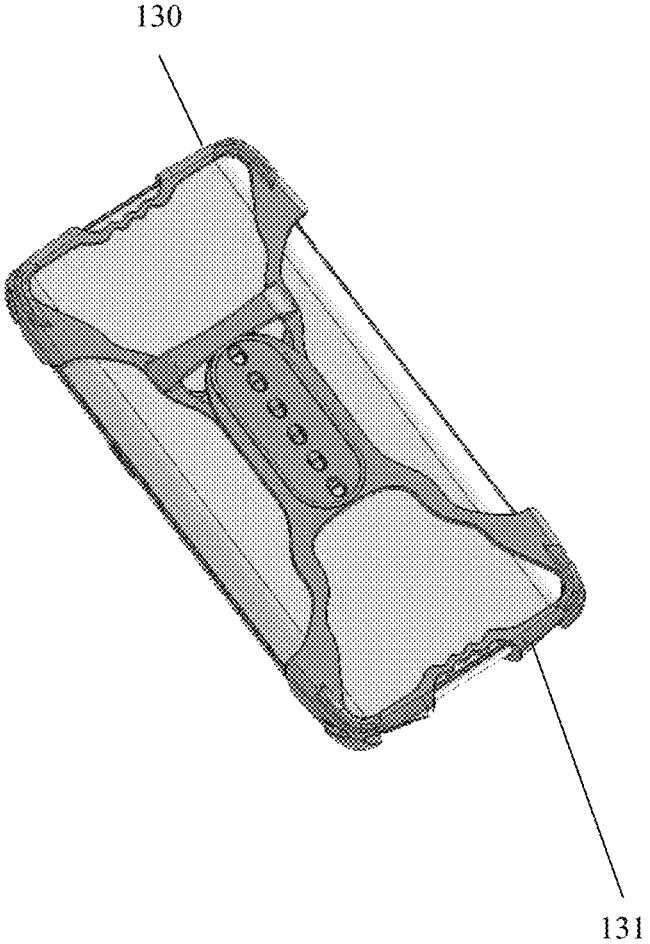

FIGS. 7-8 illustrate an alternative embodiment of the present invention where the two pieces of the thin flexible protective sheath 127 and 128 are connected in the middle of the device 129. In the embodiment of FIG. 7, the metal bars have been replaced by a fabric material, which could be leather, nylon, or any other fabric. In the embodiment of FIG. 8, the body parts of the device 130 and 131 are made from a plastic or rubber.

Figure 9:
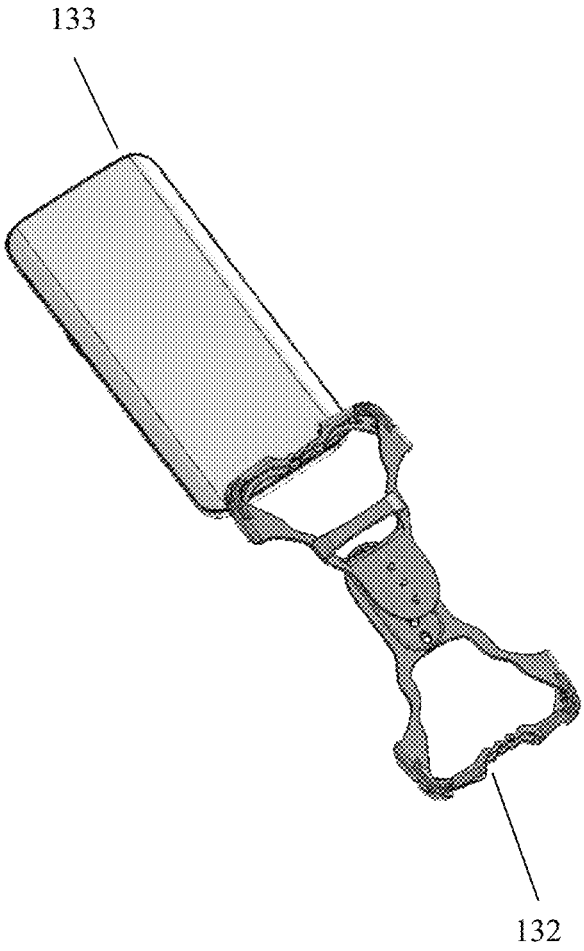
FIG. 9 illustrates an exploded or expanded view of the present invention of the previous embodiment.

FIG. 9 illustrates an exploded or expanded view of the present invention of the previous embodiment. Here the present invention 132 is shown in one embodiment, separated from an electronic mobile device 133, such as a rectangular smart phone.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A frame to protect portable electronic devices, comprising:

an upper piece comprised of a stretch rubber material for fitting over a first end of an electronic device, the upper piece having a rubber over-mold located on corners thereof and an opposing end for resting against a backside surface of the electronic device, the opposing end of the upper piece having vertically aligned openings about a longitudinal length of the frame; and a lower piece comprised of a stretch rubber material for fitting over a second end of the electronic device opposite the first end of the electronic device, the lower piece having a rubber over-mold located on corners thereof and an opposing end for resting against the backside surface of the electronic device, the opposing end of the lower piece having vertically aligned protrusions about the longitudinal length of the frame, in which the protrusions mate with the upper piece's openings, wherein the respective opposing ends of the upper piece and the lower piece enable a connection between the upper piece and the lower piece in which the connection creates the frame to protect the electronic device at least from the first end to the second end, and wherein the vertically aligned openings and protrusions are vertically adjustable to enable the frame to accommodate different sized portable electronic devices.

2. The frame of claim 1, wherein the upper and lower pieces provide coarse adjustment in a height-direction of the electronic device.

3. The frame of claim 1, wherein the connection between the upper and lower piece's opposing ends provide extension of the frame along the height-direction of the portable electronics device.

4. The frame of claim 1, further comprising expansion of the upper and lower pieces in the longitudinal and transverse directions of the electronic device.

5. The frame of claim 4, wherein expansion of the upper and lower pieces in the longitudinal and transverse directions of the electronic device is due to intrinsic elongation and stretch characteristics of the frame material.

6. The frame of claim 4, wherein the frame is constructed from a polymer compound.

7. The frame of claim 4, wherein the frame is constructed from a rubber compound.

8. The frame of claim 1, wherein the thickness of the frame is less than 2 mm.

9. The frame of claim 1, wherein the upper and lower pieces are constructed to enable full exposure of and access to all input/output connections and buttons of the device.

10. The frame of claim 1, wherein the upper and lower pieces include diagonal stretch sections which extend diagonally toward a center portion of the frame, in which the center portion is where the openings and protrusions on the upper and lower pieces, respectively, mate.

* * * * *